US009041293B2

(12) United States Patent
Chen et al.

(10) Patent No.: US 9,041,293 B2
(45) Date of Patent: May 26, 2015

(54) LAMP CONTROL SYSTEM, LAMP POWER-SAVING SYSTEM AND METHOD THEREFOR

(75) Inventors: Sui-Tsung Chen, New Taipei (TW); Ching-Ran Lee, Jinning Township, Kinmen County (TW); Jia-Hong Chen, Kaohsiung (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 205 days.

(21) Appl. No.: 13/612,712

(22) Filed: Sep. 12, 2012

(65) Prior Publication Data

US 2013/0162143 A1 Jun. 27, 2013

(30) Foreign Application Priority Data

Dec. 27, 2011 (TW) ..... 100149019 A

(51) Int. Cl.

| | |
|---|---|
| ***H05B 41/36*** | (2006.01) |
| ***H01J 61/52*** | (2006.01) |
| ***H05B 41/295*** | (2006.01) |
| ***H01J 61/72*** | (2006.01) |

(52) U.S. Cl.

CPC ..... *H01J 61/52* (2013.01); *H05B 41/295* (2013.01); *H01J 61/72* (2013.01)

(58) Field of Classification Search

USPC ..... 315/116

See application file for complete search history.

(56) References Cited

U.S. PATENT DOCUMENTS

| | | | |
|---|---|---|---|
| 4,255,690 | A | 3/1981 | Lecornet |
| 4,398,128 | A | 8/1983 | Wollank |
| 4,538,093 | A | 8/1985 | Melai |
| 4,935,669 | A | 6/1990 | Nilssen |

(Continued)

FOREIGN PATENT DOCUMENTS

| | | |
|---|---|---|
| CN | 1160979 | 10/1997 |
| CN | 1436031 | 8/2003 |

(Continued)

OTHER PUBLICATIONS

English language translation of abstract of TW 281362 (published Jul. 11, 1996).

(Continued)

*Primary Examiner* — Jason M Crawford
*Assistant Examiner* — Nelson Correa
(74) *Attorney, Agent, or Firm* — McClure, Qualey & Rodack, LLP

(57) ABSTRACT

A power-saving method for a lamp power-saving system is provided. The method includes the following steps. A lamp control unit is provided to control a fluorescent lamp. The lamp control unit includes a power conversion circuit and a preheat and lighting circuit. The preheat and lighting circuit, coupled to the power conversion circuit and two terminals of the fluorescent lamp, preheats and activates the fluorescent lamp, and outputs a feedback signal indicating a current passing through the fluorescent lamp. When the feedback signal indicates the fluorescent lamp is in a preheat mode, a resonant circuit of the preheat and lighting circuit is enabled to preheat the fluorescent lamp via a current path provided by a diode bridge of the preheat and lighting circuit. When the feedback signal indicates the fluorescent lamp is lighted, the current path of the preheat and lighting circuit is disconnected to stop preheating.

19 Claims, 11 Drawing Sheets

(56) References Cited

U.S. PATENT DOCUMENTS

| | | | | |
|---|---|---|---|---|
| 5,483,127 | A | 1/1996 | Widmayer et al. | |
| 5,703,441 | A | 12/1997 | Steigerwald et al. | |
| 5,925,990 | A * | 7/1999 | Crouse et al. | 315/307 |
| 5,969,483 | A * | 10/1999 | Li et al. | 315/225 |
| 6,008,590 | A * | 12/1999 | Giannopoulos et al. | 315/209 R |
| 6,008,593 | A | 12/1999 | Ribarich | |
| 6,259,215 | B1 | 7/2001 | Roman | |
| 6,407,511 | B1 * | 6/2002 | Yang et al. | 315/224 |
| 6,756,747 | B2 * | 6/2004 | Hsieh | 315/291 |
| 7,187,132 | B2 | 3/2007 | Bakre | |
| 7,408,307 | B2 * | 8/2008 | Ribarich | 315/291 |
| 7,486,033 | B2 * | 2/2009 | Chen et al. | 315/294 |
| 7,622,868 | B2 | 11/2009 | Baarman et al. | |
| 7,679,294 | B1 * | 3/2010 | Xiong et al. | 315/224 |
| 8,659,233 | B2 * | 2/2014 | Nerone et al. | 315/244 |

FOREIGN PATENT DOCUMENTS

| | | |
|---|---|---|
| CN | 101370344 A | 2/2009 |
| EP | 0 848 581 | 6/1998 |
| TW | 281362 | 7/1996 |
| TW | I221753 | 10/2004 |
| TW | M307929 U | 3/2007 |
| TW | I282254 | 6/2007 |
| TW | I293013 | 1/2008 |

OTHER PUBLICATIONS

English language translation of abstract of CN 1160979 (published Oct. 1, 1997).

English language translation of abstract of CN 1436031 (published Aug. 13, 2003).

English language translation of abstract of TW I221753 (published Oct. 1, 2004).

English language translation of abstract of TW I282254 (published Jun. 1, 2007).

English language translation of abstract of TW I293013 (published Jan. 21, 2008).

Wakabayashi, F.T., et al.; "Model for Electrodes' Filaments of Hot Cathode Fluorescent Lamps, During Preheating with Constant rms Current;" IEEE Transactions on Power Electronics; vol. 22; No. 3; May 2007; pp. 719-726.

Klien, D.; "A New Heating Concept for Fluorescent Lamp Ballasts;" IEEE; 2000; pp. 3428-3433.

Chondrakis, N.G., et al.; "Influence of Col Starting on the Life of T5 Fluorescent Tubes CFLs;" IEEE; 2009; pp. 3530-3536.

Buso, D., et al.; "Influence of Auxiliary Heating on the Degradation Fluorescent Lamp Electrodes Under Dimming Operation;" IEEE Transactions on Industrial Electronics; vol. 59; No. 4; Apr. 2012; pp. 1889-1897.

Adams, J., et al.; "A New Control IC for Dimmable High-Frequency Electronic Ballasts;" IEEE; 1999; pp. 713-719.

TW Notice of Allowance dated Jan. 24, 2014.

English Abstract translation of TWM307929 (Published Mar. 11, 2007).

English Abstract translation of CN101370344 (Published Feb. 18, 2009).

* cited by examiner

LAMP CONTROL SYSTEM, LAMP POWER-SAVING SYSTEM AND METHOD THEREFOR

This application claims the benefit of Taiwan application Serial No. 100149019, filed Dec. 27, 2011, the disclosure of which is incorporated by reference herein in its entirety.

BACKGROUND

1. Technical Field

The disclosed embodiments relate in general to a lamp power-saving system, and more particularly to a lamp control system, a lamp power-saving system and a power-saving method therefor.

2. Description of the Related Art

The lighting industry selects and applies light sources from earlier incandescent light bulbs, fluorescent lamps (e.g., straight-tube fluorescent lamps and compact fluorescent lamps), halogen lamps and metal halide lamps to current light-emitting diode (LED) lamps. These light sources are demanded according to conditions in different environments. LED light sources, being small in volume, high in light intensity and diversified in color, are prevalent in the lighting industry nowadays.

For a fluorescent lamp, an electronic ballast is required. A common electronic ballast is a single-function control structure capable of only activating a lamp and controlling a lighting current limit. Due to the single function of the electronic ballast, the electronic ballast is unable to fulfill low power consumption lighting since the power saving efficiency is low, and thus also offers insufficient competitiveness. As a result, fluorescent lamps are faced with the jeopardy of market competitiveness as well as technical development.

SUMMARY

The disclosure is directed to a lamp control system, a lamp power-saving system and a power-saving method therefor.

According to one embodiment, a lamp control system is provided. The lamp control system includes a lamp control unit and a system control unit. The lamp control unit, including a power conversion circuit and a preheat and lighting circuit, is for controlling a fluorescent lamp. The power conversion circuit, including a DC signal input terminal and an AC signal output terminal, converts a DC signal to an AC signal and output the AC signal. The preheat and lighting circuit, coupled to the AC signal output terminal and two terminals of the fluorescent lamp, preheats and activates the fluorescent lamp, and outputs a feedback signal indicating a current flowing through the fluorescent lamp. In response to the feedback signal, the system control unit controls the preheat and lighting circuit. In response to the feedback signal indicating the fluorescent lamp is in a preheat mode, the system control unit enables the preheat and lighting circuit to preheat the fluorescent lamp. In response to the feedback signal indicating the fluorescent lamp is lighted, the system control unit controls the preheat and lighting circuit to stop preheating.

According to another embodiment, a lamp power-saving system is provided. The lamp power-saving system includes a power management unit and the foregoing lamp control system. The power management unit includes an AC power input terminal and a DC signal output terminal. The DC signal input terminal of the power conversion unit is coupled to the DC signal output terminal of the power management unit.

According to an alternative embodiment, a power-saving method for a lamp power-saving system is provided. The method includes steps below. A lamp control unit is provided to control a fluorescent lamp. The lamp control unit includes a power conversion circuit and a preheat and lighting circuit. The preheat and lighting circuit, coupled to the power conversion circuit and two terminals of the fluorescent lamp, preheats and activates the fluorescent lamp, and outputs a feedback signal indicating a current passing through the fluorescent lamp. When the feedback signal indicates the fluorescent lamp is in a preheat mode, a resonant circuit of the preheat and lighting circuit is enabled to preheat the fluorescent lamp via a current path provided by a diode bridge of the preheat and lighting circuit. When the feedback signal indicates the fluorescent lamp is lighted, the current path of the preheat and lighting circuit is disconnected to stop preheating.

Figure 1:
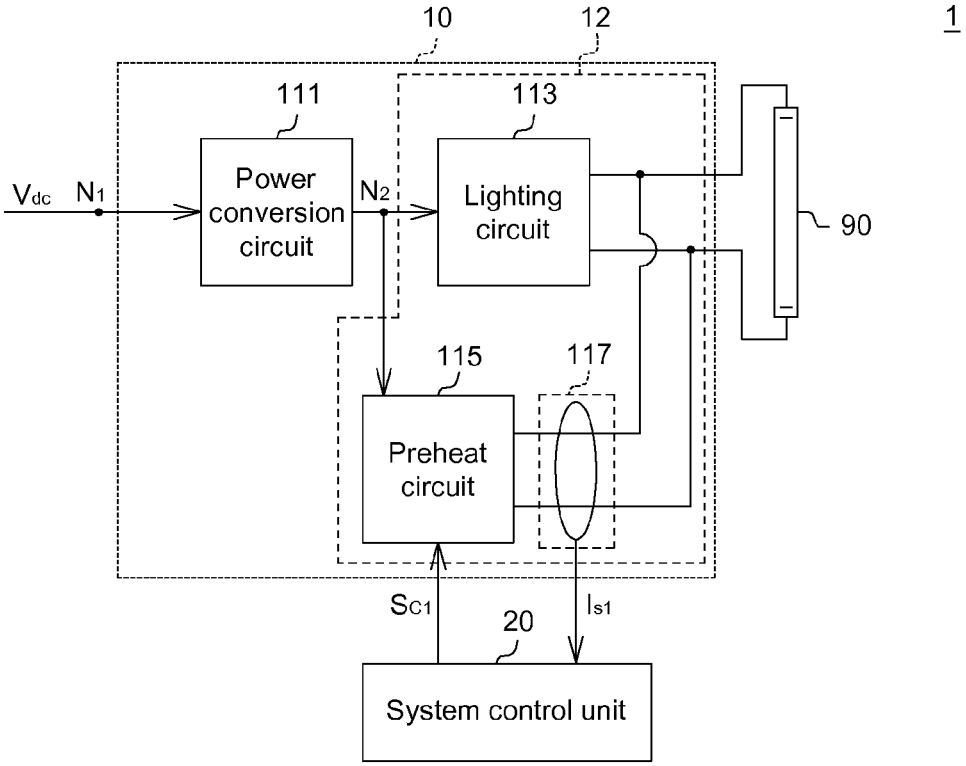
FIG. 1 is a block diagram of a lamp control system according to one embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

Embodiments of a lamp control system, a lamp power-saving system and a power-saving method for a lamp power-saving system shall be described below. FIG. 1 is a block diagram of a lamp control system according to one embodiment. The lamp control system is suitable in applications for controlling one or several lamps. For example, the lamp control system may be utilized as an electronic ballast, or may be implemented in a lamp power-saving system in FIG. 4. The lamp may be a fluorescent lamp in various sizes in shapes, e.g., a T5 or T8 fluorescent lamp.

A lamp control system 1 depicted in FIG. 1 includes a lamp control unit 10 and a system control unit 20. The lamp control unit 10 receives a DC signal Vdc for controlling a fluorescent lamp 90. The lamp control unit 10 further outputs a feedback signal Is1, e.g., a voltage or current signal, to reflect a current passing through the fluorescent lamp 90. The lamp control unit 10 includes a power conversion unit 111 and a preheat and lighting circuit 12. The power conversion circuit 111, for converting the DC signal Vdc to an AC signal and output the AC signal, includes a DC signal input terminal $N_1$ and an AC signal output terminal $N_2$. The preheat and lighting circuit 12, coupled to the AC signal input terminal $N_2$ and two terminals of the fluorescent lamp 90, preheats and activates the fluorescent lamp 90, and outputs the feedback signal Is1 indicating the current passing through the fluorescent lamp 90.

In response to the feedback current signal Is1, the system control unit 20 controls the preheat and lighting circuit 12 in the lamp control unit 10 to enable the lamp control unit 10 to operate in different operating modes. For example, in response to the feedback signal Is1 indicating the fluorescent lamp 90 is in a preheat mode, the system control unit 20 enables the preheat and lighting circuit 12 to preheat the fluorescent lamp 90. In response to the feedback signal Is1 indicating the fluorescent lamp 90 is lighted, the system control unit 20 controls the preheat and lighting circuit 12 to stop preheating and to further allow the fluorescent lamp 90 function normally. By terminating the preheating, energy consumption is reduced. In another embodiment, e.g., with a mechanism for dimming control or bias control shown in FIG. 4, the lamp control system 1 is further capable of preheating or eliminating standing waves caused by dimming. Alternatively, with a mechanism for protection control shown in FIG. 4, the lamp control system 1 is further capable of entering a protection mode to stop operating and thus preventing hazards when the lamp encounters an abnormality. Therefore, the lamp control system 1 in FIG. 1 may be implemented to various applications for providing design flexibilities regarding to control of a lamp.

Referring to FIG. 1, the preheat and lighting circuit 12 includes a lighting circuit 113, a preheat circuit 115 and a current detection device 117. The lighting circuit 113 and the preheat circuit 115, both coupled to the power conversion circuit 111 (via the AC signal output terminal $N_2$) and the two terminals of the fluorescent lamp 90, are for preheating and activating the fluorescent lamp 90. The current detection device 117 detects the current of the fluorescent lamp 90 to output the feedback signal Is1. For example, in response to the feedback signal Is1 indicating the fluorescent lamp 90 is in a preheat mode, the system control unit 20 controls the preheat circuit 115 to perform preheating at the two terminals of the fluorescent lamp 90; in response to the feedback signal Is1 indicating the fluorescent lamp 90 is lighted, the system control unit 20 disables the preheat circuit 115 to stop preheating and continues to drive the fluorescent lamp 90 via the lighting circuit 113.

Figure 2:
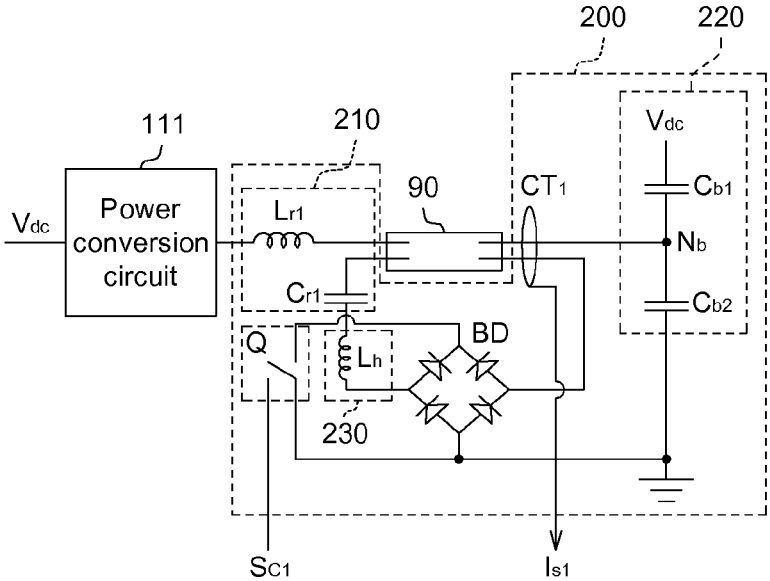
FIG. 2 is a circuit diagram of an embodiment according to the lamp control unit in FIG. 1.

FIG. 2 is a circuit diagram of an embodiment of the lamp control unit 10 in FIG. 1. The lamp control unit 10 includes a power conversion circuit 111 and a preheat and lighting circuit 200. The preheat and lighting circuit 200 includes a resonance circuit 210, a diode bridge BD, a switching device and a current detection device. The resonance circuit 210, coupled to one of the two terminals of the fluorescent lamp 90, includes a capacitor Cr1 and an inductor Lr1, or other resonance circuits. The diode bridge BD has two terminals respectively coupled to the two terminals of the fluorescent lamp 90, with one of the terminals coupled to the fluorescent lamp 90 via the resonance circuit 210. The switching device includes a switch unit Q. The diode bridge BD further includes two other terminals, and the switching device is coupled between the two other terminals of the diode bridge BD. For example, the current detection device is a current transformer $CT_1$ for detecting the current of the fluorescent lamp 90 to output the feedback signal Is1.

In this embodiment, in response to the feedback signal Is1, the system control unit 20 controls the switching device to enable the lamp control unit 10 to operate in different operating modes. For example, in response to the feedback signal Is1 indicating the fluorescent lamp 90 is in a preheat mode, the system control unit 20 enables the switching device, e.g., through a first control signal $S_{c1}$ for enabling, to turn on the switch unit Q of the switching device, so as to allow the resonance circuit 210 to perform preheating at the two terminals of the fluorescent lamp 90 via a path provided by the diode bridge BD. In the preheat mode, the AC signal (e.g., a current in high-frequency square waves) outputted from the power conversion unit 111 is filtered by the resonance circuit 210 to become sinusoidal waves for preheating filaments at the two terminals of the fluorescent lamp 90. In response to the feedback signal Is1 indicating the fluorescent lamp 90 is lighted, the system control unit 20 disables the switching device, e.g., through a control signal $S_{c1}$ indicating disabling, to turn off the switch unit Q of the switching device so as to further stop preheating the fluorescent lamp 90. At this point, through the inductor Lr1 of the resonance circuit 210, the current of the AC signal outputted form the power conversion circuit 111 directly enters and lights the fluorescent lamp 90. Meanwhile, power saving is achieved since the current no longer passes through the path provided by the capacitor Cr1 and the diode bridge BD.

In another embodiment, in response to a dimming signal, the system control unit 20 enables the switching device after the fluorescent lamp 90 is activated, so as to allow the resonance circuit 210 to again perform preheating at the two terminals of the fluorescent lamp 90 via the path provided by the diode bridge BD to stabilize light output of the fluorescent lamp 90 in a dimming mode. In an embodiment, the preheat and lighting circuit 200 further includes an anti-surge device 230, e.g., an inductor Lh. The anti-surge device 230 is coupled between the resonance circuit 210 and the diode bridge BD. In a dimming mode, an instantaneous surge current may be evoked when the resonance circuit 210 again performs preheating. The anti-surge device 230 is capable of mitigating or suppressing effects that the surge current imposes on the overall circuit. In another embodiment, the preheat and lighting circuit 200 further includes an isolation circuit 220 coupled to one of the two terminals of the fluorescent lamp 90. For example, the isolation circuit 220 receives the DC signal Vdc to provide a divided voltage to the connected terminal of the fluorescent lamp 90. Referring to FIG. 2, the isolation circuit 220 includes isolation capacitors Cb1 and Cb2, and provides a voltage approximately equal to Vdc/2 at a node Nb. The isolation circuit 220 may also be implemented in other forms, e.g., the isolation circuit 220 may include only one isolation capacitor Cb2.

Figure 3:
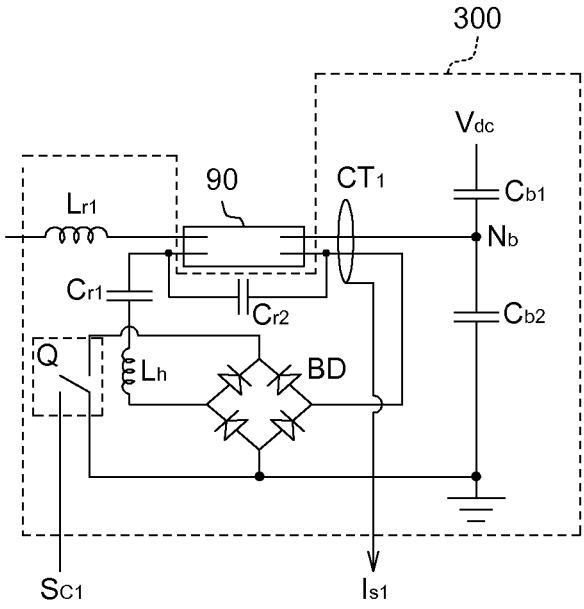
FIG. 3 is a circuit diagram of another embodiment of a preheat and lighting circuit in FIG. 2.

FIG. 3 is a circuit diagram of another embodiment of the preheat and lighting circuit in FIG. 2. Compared to the preheat and lighting circuit 200 in FIG. 2, a preheat and lighting circuit 300 in FIG. 3 further includes a capacitive circuit, e.g., a capacitor Cr2, coupled between the two terminals of the fluorescent lamp 90. In the preheat mode, similar to the function of the resonance circuit 210, the capacitive circuit also allows the preheat current to flow through the filaments at the two terminals of the fluorescent lamp 90 to achieve a soft activation. Further, when the switch unit Q of the switching device is disabled, i.e., when the resonance circuit 210 is disconnected (or cut off), the capacitive circuit is capable of providing a DC bias to the fluorescent lamp 90, so as to offer the fluorescent lamp 90 with a stable lighting condition by lighting the fluorescent lamp 90 with a sufficient rated voltage.

Figure 4:
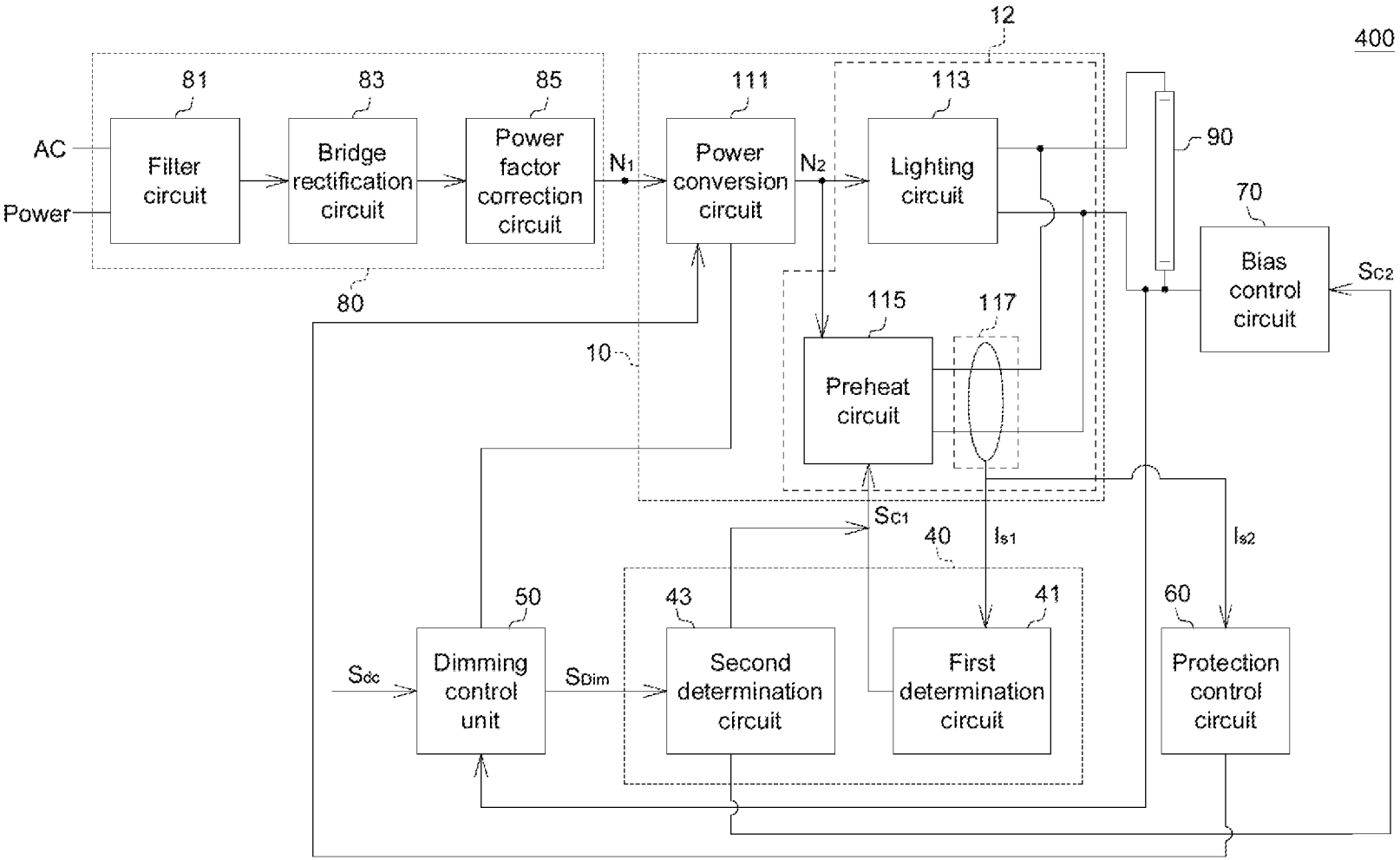
FIG. 4 is a block diagram of a lamp power-saving system according to one embodiment.

Based on the embodiments of the lamp control system 1, other extended circuit elements or circuit units may be added to develop into a lamp power-saving system, e.g., a lamp power-saving system as shown in a block diagram in FIG. 4. A lamp power-saving system 400 includes a power management unit 80, a lamp control unit 10 and a system control unit 40. The power management unit 80 includes an AC power input terminal and a DC signal output terminal. The lamp control unit 10 is implemented as the embodiments in FIGS. 1 to 3. The lamp control unit 10 has a DC signal input terminal $N_1$ coupled to the DC signal output terminal of the power management unit 80.

For example, the power management unit 80 includes a filter circuit 81, a bridge rectification circuit 83 and a power factor correction circuit 85. The filter circuit 81 is coupled to an AC power source. The power factor correction circuit 85 outputs a high-voltage DC signal. For example, the filter circuit 81 includes an inductor and a capacitor, and is for removing noises in the AC power signal to reduce harmonic components and improve power quality. For example, the bridge rectification circuit 83 rectifies a 60 Hz AC power signal to a 120 Hz DC power signal to provide the power characteristics required by the system. For example, the power factor correction circuit 85 adjusts a phase angle difference of voltage and current to achieve in-phase voltage and current. The power factor correction circuit 85 further functions in cooperation with the filter circuit 81 to enhance power efficiency.

Figure 5:
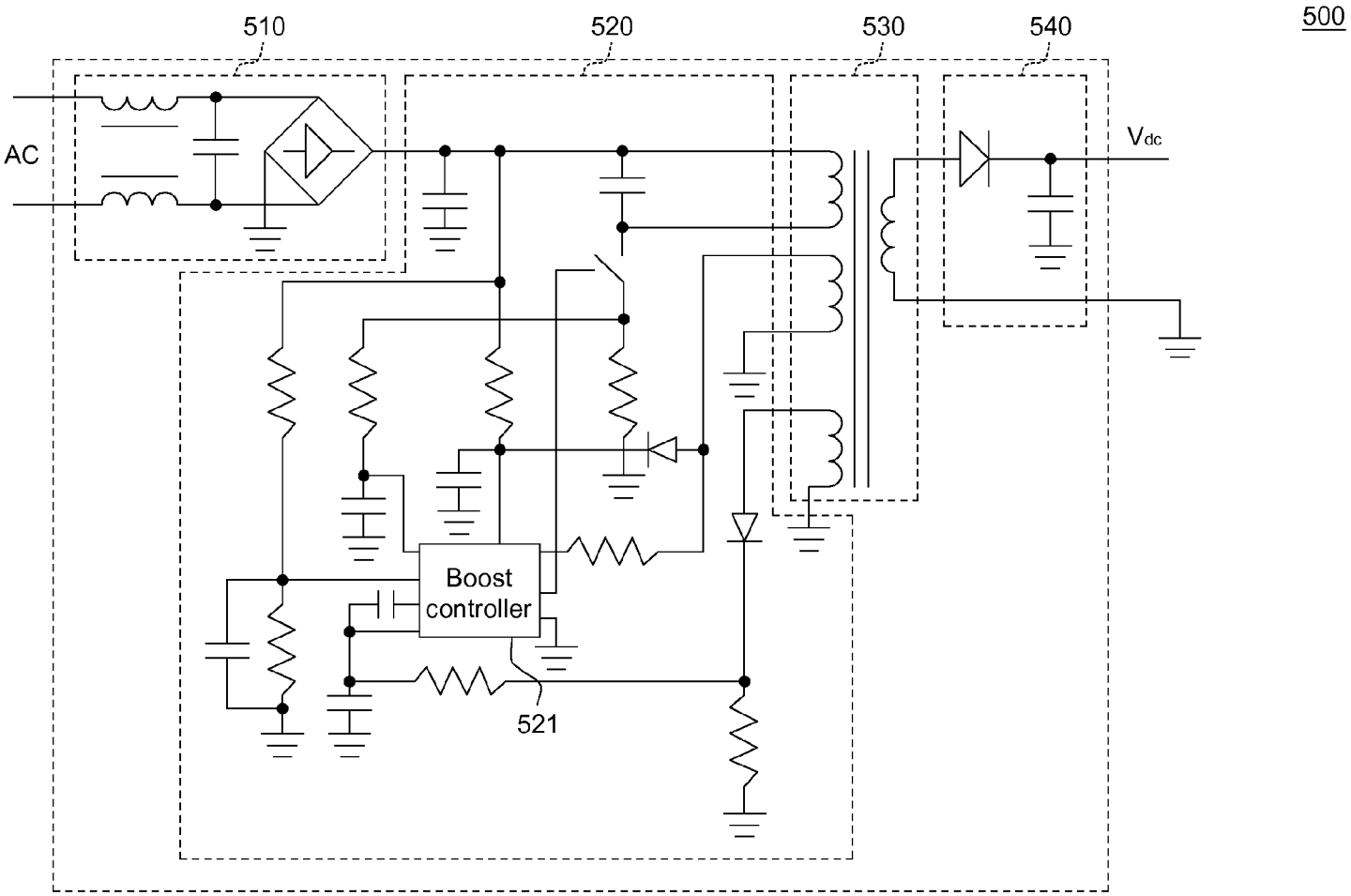
FIG. 5 is a circuit diagram of a power management unit according to one embodiment.

FIG. 5 is a circuit diagram of a power management unit according to another embodiment. A power management unit 500 includes a first rectification filter circuit 510, a boost circuit 520, a transformer 530 and a second rectification filter circuit 540. The first rectification filter circuit 510 is coupled to the AC power input terminal of the power management unit 500. The boost circuit 520 is coupled to the first rectification filter circuit 510. The transformer 530 has a primary side and a secondary side. The boost circuit 520 is coupled between the primary side of the transformer 530 and an output terminal of the first rectification filter circuit 510. The second rectification filter circuit 540 includes an input terminal coupled to the secondary side of the transformer 530, and an output terminal coupled to the DC signal input terminal $N_1$ of the lamp control unit 10 to provide the DC signal Vdc. For example, the second rectification filter circuit 540 has its output coupled to the DC signal input terminal $N_1$ of the lamp control unit 10 in FIG. 4. For example, the boost circuit 520 is implemented by a boost controller 521, e.g., an integrated circuit such as ST6561, MC33262, MC33265. The power management unit 500 in FIG. 5 employs the transformer 530 that provide isolation and boosting so as to enhance overall system safety. For example, the first rectification filter circuit 510 receives a 60 Hz AC power signal in a range of 80V to 265V. The AC power signal is EMI filtered and passed through the bridge rectification circuit, and then processed by the power factor correction of the boost circuit 520. Therefore, the current harmonics and voltage and current phase difference of the AC power signal are improved to thereby enhance overall power quality. Next, the AC power signal passes through the coupled transformer 530 to increase a voltage level thereof at the secondary side of the transformer 530, and is outputted as the DC signal Vdc after being rectified and filtered by the second rectification filter circuit 540. As a result, the DC signal Vdc, e.g., a DC signal from 400V to 430V, has a zero phase difference and a high power factor with minimal harmonics to provide a stable power signal for the power-saving system.

Based on the lamp power-saving system in FIG. 4, different embodiments of a fluorescent lamp shall be described below.

In one embodiment, the system control unit 40 includes a first determination circuit 41. According to the feedback signal Is1, the first determination circuit 41 outputs the first control signal $S_{c1}$ for activating or terminating preheating of the preheat and lighting circuit 12.

In one embodiment, the lamp power-saving system 40 further includes a dimming control unit 50 coupled to the power conversion circuit 111. In response to a setting signal Sdc, the dimming control unit 50 outputs a dimming signal $S_{Dim}$ and controls the power conversion circuit 111 for dimming. In one embodiment, the system control unit 40 further includes a second determination circuit 43. In response to the dimming signal $S_{Dim}$, after the fluorescent lamp 90 is activated, the second determination circuit 43 preheats the fluorescent lamp 90 through the first control signal $S_{c1}$ for enabling the preheat circuit 115 in the preheat and lighting circuit 12. Alternatively, the second determination circuit 43 enables the switch unit Q of the switching device and allows the resonance circuit 210 to perform preheating at the two terminals of the fluorescent lamp 90 via the path provided by the diode bridge BD. For example, the dimming control unit 50 is implemented by a dimming control unit 650 in FIG. 6.

In another embodiment, the lamp power-saving system 400 further includes a bias control circuit 70 coupled to one of the two terminals of the fluorescent lamp 90. In response to the dimming signal $S_{Dim}$, after the fluorescent lamp 90 is activated, the second determination circuit 43 of the system control unit 40, apart from enabling the preheat circuit 115 or the switch unit Q of the switching device, further enables the bias control circuit 70 by outputting a second control signal $S_{c2}$ to generate a bias signal for eliminating standing waves generated by the fluorescent lamp 90.

In yet another alternative embodiment, the lamp power-saving system 400 further includes a protection control circuit 60 coupled to a control terminal of the power conversion circuit 111. In response to the feedback signal Is2 indicating an overcurrent event, the protection control circuit 60 provides a bypass (or a path) connecting to the control terminal of the power conversion circuit 111 to stop the power conversion circuit 111 from outputting the AC signal at the AC signal output terminal $N_2$. For example, the protection control circuit 60 is a protection control circuit 660 in FIG. 6.

Figure 6:
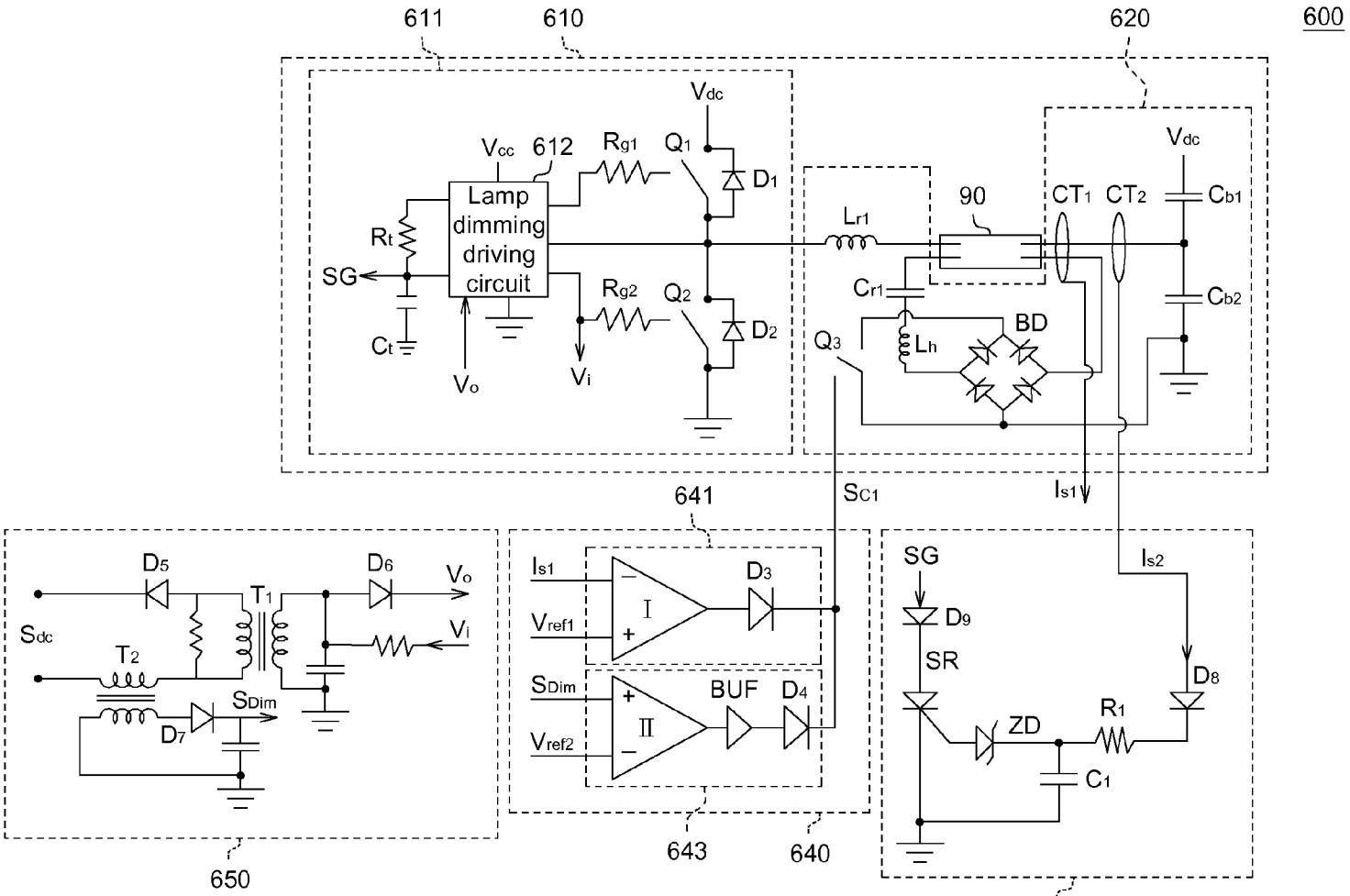
FIGS. 6 and 7 are circuit diagrams of embodiments according to the lamp power-saving system in FIG. 4.
Figure 7:
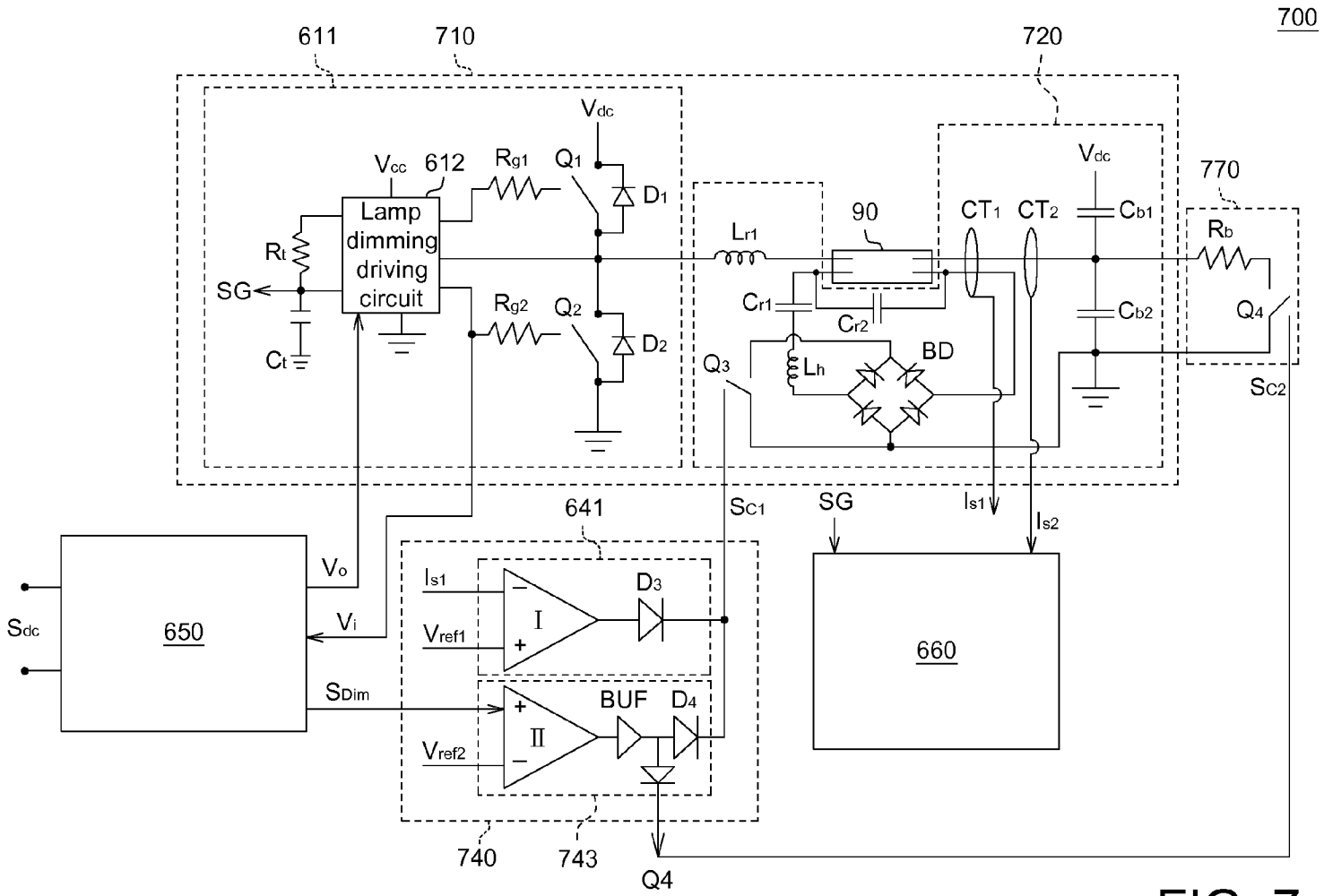

FIGS. 6 and 7 are circuit diagrams of respectively embodiments according to the lamp power-saving system in FIG. 4. Referring to FIG. 6, a lamp power-saving system 600 includes a lamp control unit 610, a system control unit 640, a dimming control unit 650 and a protection control unit 660.

The lamp control unit 610 includes a power conversion circuit 611 and a preheat and lighting circuit 620. The power conversion circuit 611 is for performing DC-to-AC conversion. For example, the power conversion circuit 611 implemented by a half-wave bridge configuration, which includes a lamp dimming driving circuit 612 and two switch units. For example, the two switch units are two power transistors $Q_1$ and $Q_2$ connected in series to form a switching device. The lamp dimming driving circuit 612 outputs two pulse signals having different phases, and generates control signals via resistors Rg1 and Rg2 to alternately turn on the two switch units $Q_1$ and $Q_2$ so as to convert the DC signal Vdc to a high-frequency AC signal, thereby fulfilling the characteristics for lighting a fluorescent lamp. The power conversion circuit 611 further includes a frequency output terminal for outputting a frequency signal Vi, a frequency control terminal for receiving a frequency-change signal Vo, and a control terminal for outputting a signal SG. The power conversion circuit 611 further includes a resistor Rt coupled to the lamp dimming driving circuit 612 and the signal SG and a capacitor Ct coupled to the signal SG and ground. The power conversion circuit 611 further includes two diodes $D_1$ and $D_2$ coupled to the switch units $Q_1$ and $Q_2$, respectively. Through the frequency control terminal, the frequency of the high-frequency AC signal outputted from the power conversion circuit 611 may be modified to fulfill the characteristics for lighting a fluorescent lamp or alternatively to be utilized for dimming. For example, the lamp dimming driving circuit 612 is a driver, 6574 or 2028 manufactured by STM.

In FIG. 6, the preheat and lighting circuit 620 is implemented in a structure similar to that in FIG. 2. A current detection device includes current transformers $CT_1$ and $CT_2$. A reason for the two current transformers is to prevent mutual interference. Alternatively, one current transformer may be utilized instead. A lighting circuit (i.e., a resonance circuit) of the preheat and lighting circuit 620 is connected to a half-bridge structure of the power conversion circuit 611 through an inductor and a capacitor (e.g., Lr1 and Cr1) connected in parallel or in series. The lighting circuit of the preheat and lighting circuit 620 filters and oscillates the AC signal (e.g., square waves at 40 kHz or 70-80 kHz) outputted from the power conversion circuit 611, and outputs a high-voltage power (sinusoidal waves) for activating the fluorescent lamp. The preheat circuit includes the inductor Lh connected in series with the capacitor Cr1, the diode bridge BD and a switch unit $Q_3$ (i.e., the preheating circuit including the anti-surge device, the diode bridge and the switching device). Before activating the fluorescent lamp, the preheating current flows through filaments of the lamp and passes through the preheat circuit, so as to provide a current for preheating the filaments at the two terminals of the lamp for a soft activation. Thus, the lamp is prevented from a high-voltage activation, which may lead to blackening of the lamp head or even reduce the lifespan of the lamp.

The system control unit 640 includes a first determination circuit 641 and a second determination circuit 643. The first determination circuit 641 includes a comparator I and a rectifier diode $D_3$. The second determination circuit 643 includes a comparator II, a delay circuit BUF and a diode $D_4$. When the lamp is activated, the preheat circuit first generates the preheat current that flows through the lamp filaments, and the current transformer $CT_1$ then senses the current of the lamp and outputs a feedback signal Is1 to the comparator I of the first determination circuit 641. The comparator I of the first determination circuit 641 compares the feedback signal Is1 with a threshold Vref1. When the feedback signal Is1 is smaller than or equal to the threshold Vref1, the comparator I transmits a first control signal Sc1 for enabling (e.g., a high-level logic signal) to trigger the switching device, e.g., to turn on the switch unit $Q_3$. When the feedback signal Is1 is greater than the threshold Vref1 indicating that the lamp is lighted, majority of preheating current generated by the lighting circuit is flown to the fluorescent lamp, and the current transformer $CT_1$ instantaneously detects the current of the fluorescent lamp and outputs the feedback signal Is1 to the comparator I so as to make comparison with the threshold Vref1. Meanwhile, the comparator I transmits a first control signal Sc1 indicating disabling (e.g., a low-level logic signal) to turn off the switch unit $Q_3$ and thus disconnecting the preheat circuit including the capacitor Cr1.

The dimming control unit 650 is coupled to a frequency output terminal and a frequency control terminal of the power conversion circuit 611. In response to a setting signal Sdc, the dimming control unit 650 outputs a dimming signal $S_{Dim}$ to control the power conversion circuit 611 via the frequency control terminal to performing dimming. As shown in FIG. 6, the dimming control unit 650 includes two isolation transformers $T_1$ and $T_2$, and three diodes $D_5$, $D_6$ and $D_7$. One terminal at a secondary side of the transformer $T_1$ receives a frequency signal Vi of the lamp dimming driving circuit 612. The frequency signal Vi is modulated by a DC signal at a primary side of the transformer $T_1$, and is outputted as a frequency-change signal Vo at the other terminal of the secondary side of the transformer $T_1$. With the frequency-change signal Vo, the frequency of the lamp dimming driving circuit 612 is modified to control an operating frequency of the lighting circuit to further change an output brightness of the fluorescent lamp. A transformer T2 is connected in series to one terminal of the DC signal modulation circuit to track and sense the DC signal at all times, i.e., to detect the changes of the setting signal Sdc. The dimming signal $S_{Dim}$ is outputted from one terminal of the secondary side of the transformer T2 to the second determination circuit 643 of the system control unit 640. For example, the dimming signal $S_{Dim}$ is outputted to the second determination circuit 643, e.g., the comparator II, to serve as a reference of dimming current compensation control of the preheat circuit. Further, the dimming control unit 650 may be implemented by a digital circuit, and the setting signal Sdc may also be a digital input signal.

The system enters a dimming standby mode after the lamp is fully activated. In a non-dimming condition, the dimming signal $S_{Dim}$ outputted from the secondary side of the transformer T2 is zero. The dimming signal $S_{Dim}$ is compared with a threshold Vref2 (Vref2>Vref1) by the comparator II, and is passed through the delay circuit BUF to obtain a low-level logic signal. Pointing this way, the system maintains the original lighting condition. In a dimming condition, the dimming signal $S_{Dim}$ outputted from the secondary side of the transformer T2 is non-zero. The dimming signal $S_{Dim}$ is compared by the comparator II, and is passed through the delay circuit BUF to obtain an enable signal (e.g., a high-level logic signal). The system is then in a dimming mode, and so the enable signal turns on the switch unit $Q_3$ to again activate the preheat circuit. The activated preheat circuit then allows the current to flow through filaments of the fluorescent lamp for dimming current compensation, thereby stabilizing a low-power output of the fluorescent lamp. When the switch unit $Q_3$ is instantaneously turned on and the preheating device is activated, an instantaneous surge current is rushed into the capacitor Cr1. However, the serially connected inductor Lh is capable of suppressing and absorbing the instantaneous surge current, so that the units or circuits are prevented from damages resulted by the instantaneous voltage change in the capacitor Cr1.

The delay circuit in the second determination circuit 643, e.g., a buffer, is for buffering signals outputted by the comparator II to prevent the signals outputted by the comparator II from clashing with the signals outputted by the comparator I. A delay period of the delay circuit is set to greater than an activation period, e.g., the delay period is set to approximately 3 seconds. More specifically, when the lamp is fully activated, the switch unit $Q_3$ then receives the conduction control triggered by the signal outputted by the second determination circuit 643 to further enter the dimming mode.

The protection control circuit 660 is coupled to the control terminal (for outputting the signal SG) of the power conversion circuit 611. In response to the feedback Is2 indicating an overcurrent event, the protection control circuit 660 provides a bypass connecting to the control terminal, so as to prompt the power conversion circuit 611 to stop outputting the AC signal. The protection control circuit 660 includes at least two rectifiers (e.g., diodes $D_8$ and $D_9$), a current limiter (e.g., a resistor $R_1$), a filter (e.g., a capacitor $C_1$), a level determination element (e.g., a diode element ZD) and a protection controller (e.g., silicon-controlled element SR). In the event of an activation failure of the fluorescent lamp, a rectification effect is likely incurred. The rectification effect causes an instantaneous rise in the current such that the risen current may even exceed the rated current of the fluorescent lamp. At this point, the current transformer $CT_2$ senses the current of the fluorescent lamp and outputs the feedback signal Is2. When a level between the current limiter (i.e., the resistor $R_1$) and the filter (i.e., the capacitor $C_1$) exceeds a threshold set by the level determination element (i.e., the diode ZD), the current passes through the diode element ZD and triggers the conduction of the silicon-controlled element SR. Hence, the driving signal SG from the control terminal of the power conversion circuit 611 is bypassed to a ground terminal to terminate operations of the power conversion circuit 611, i.e., to stop outputting the AC signal. For example, the level determination element is a zener diode or a diode-for-alternating-current (DIAC). For example, the protection controller is a triode-for-alternating current (TRIAC), or a silicon-controlled rectifier (SCR).

Further, in an open circuit formed when the fluorescent lamp is removed or is not connected to an enabled lighting circuit, the power conversion circuit does not provide any output. Under such conditions, the lamp power-saving system 400 enters automatic open-circuit protection to prevent an open-circuit high voltage from damaging the lamp power-saving system 400.

FIG. 7 is a circuit diagram of another embodiment of the lamp power-saving system 400 in FIG. 4. Compared to FIG. 6, a preheat and lighting circuit 720 in a lamp power-saving system 700 is implemented by a circuit similar to that in FIG. 3. The preheat and lighting circuit 720 includes a capacitive circuit, e.g., a capacitor Cr2, with the capacitor Cr1 is greater than the capacitor Cr2 in capacitance. The preheat and lighting circuit 720 is coupled to a bias control circuit 770, which is coupled to one of the two terminals of the fluorescent lamp 90. Compared to FIG. 6, a second determination circuit 743 of a system control unit 740 further outputs a second control signal Sc2 for controlling the bias control circuit 770. In response to the dimming signal $S_{Dim}$, after activating the fluorescent lamp 90, the system control unit 740 enables the switch unit $Q_3$ of the switching device, and enables the bias control circuit 770 to generate a bias signal for eliminating standing waves generated by the fluorescent lamp 90. For example, the bias control unit 770 includes a resistor Rb and a switching device with a switch unit $Q_4$.

For example, in a dimming mode, standing waves are incurred in the fluorescent lamp when the fluorescent lamp is in state of having a low optical output power e.g. about lower than 10%. In this case, the switch unit $Q_4$ of the switching device is enabled by receiving the second control signal $Sc_2$ outputted by the second determination circuit 743 so as to generate a bias signal. The bias signals then passes through the fluorescent lamp to eliminate the standing waves.

In this embodiment, the preheat circuit further includes a capacitor Cr2 coupled to the two terminals of the fluorescent lamp, with the capacitor Cr1 being far greater than Cr2. Before activating the fluorescent lamp, the preheat current flows through the filaments of the fluorescent lamp and passes through the preheat circuit including the capacitors Cr1 and Cr2. A target of such approach is also to provide a current for heating the filaments at the two terminals of the fluorescent lamp to achieve a soft activation. Thus, the lamp is prevented from a high-voltage activation, which may lead to blackening of the lamp head or even reduce the lifespan of the lamp. Further, when the preheat circuit including the capacitor Cr1 is disconnected, the capacitor Cr2 is capable of providing a DC bias to the fluorescent lamp, so that the fluorescent lamp is still lighted by a sufficient rated voltage in a stable lighted condition.

Details of the preheat circuit including the capacitors Cr1 and Cr2 are to be described below. When the fluorescent lamp is activated, in a preheat mode, the switch unit $Q_3$ is turned on by the first control signal $S_{c1}$ for enabling. Meanwhile, a minute current also passing through the circuit of the capacitor Cr2 can be neglected. When the fluorescent lamp is lighted, the switch unit $Q_3$ is turned off by the first control signal $S_{c1}$ indicating disabling. Similarly, a minute current also passing through the circuit of the capacitor Cr2 can similarly be neglected.

Figure 8:
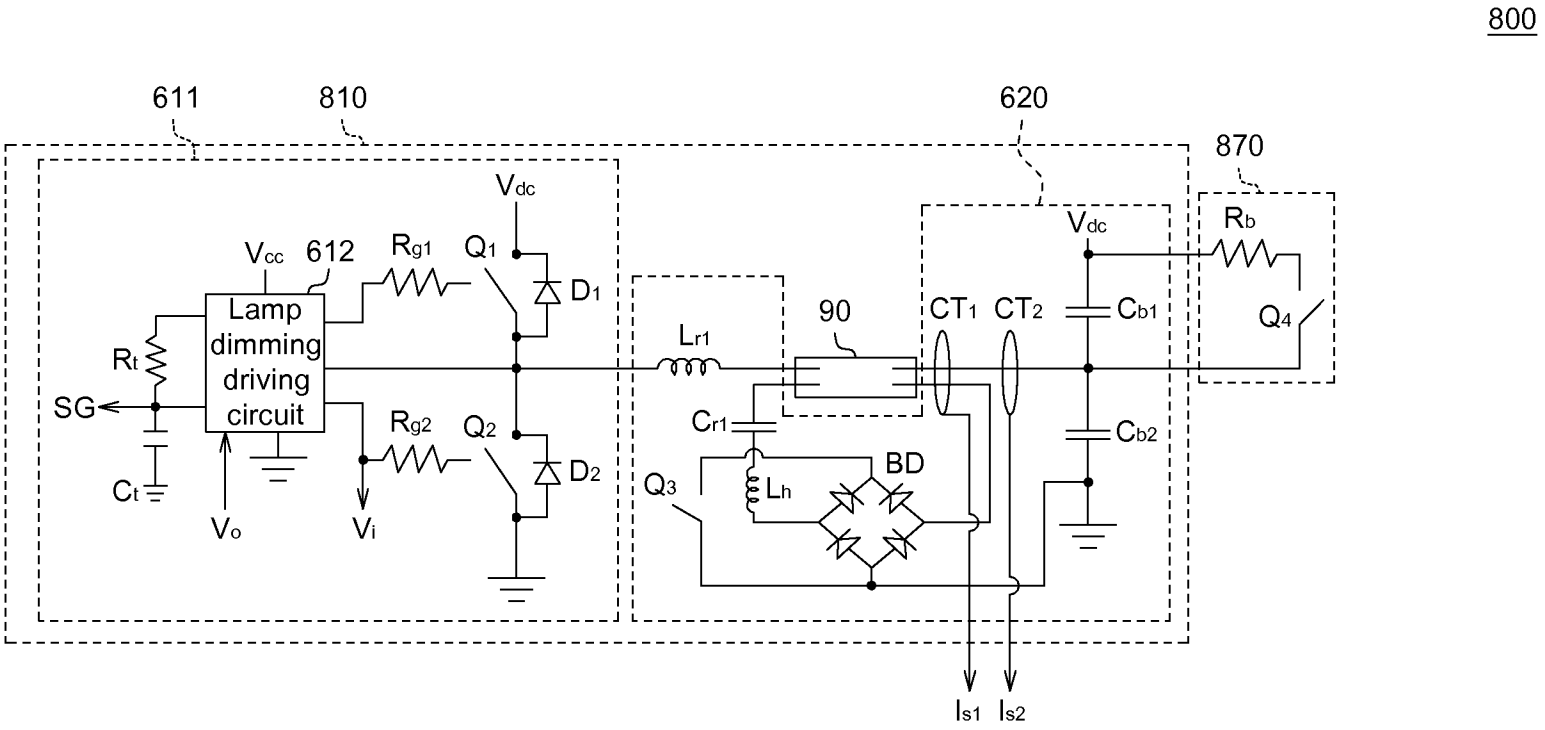
FIGS. 8 and 9 are circuit diagrams of other embodiments according to the lamp power-saving system in FIG. 4.
Figure 9:
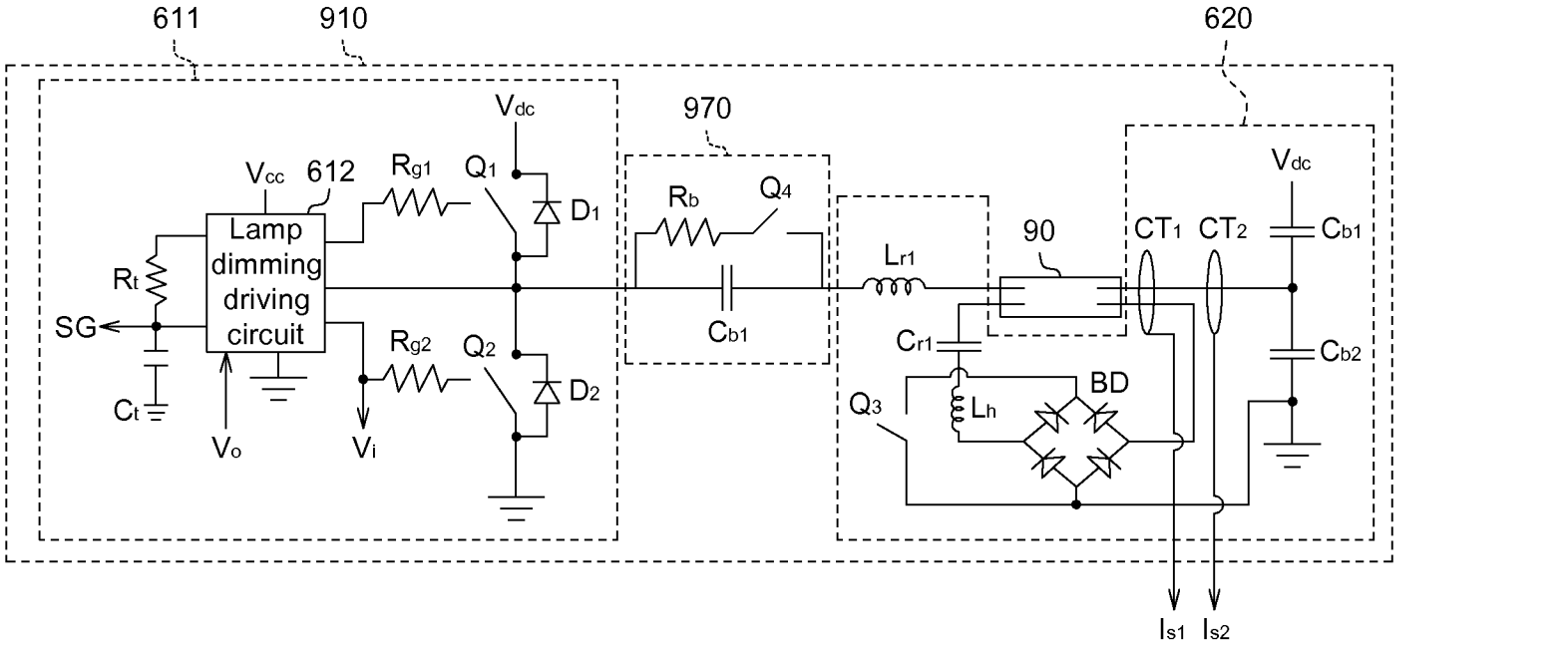

FIGS. 8 and 9 are circuit diagrams of embodiments of the lamp control unit in the lamp power-saving system in FIG. 6. Details of similar components are not repeated herein for brevity. In FIG. 8, a lamp control unit 810 of a lamp power-saving system 800 has a structure similar to that of the lamp control circuit 610 in FIG. 6. However, the lamp control unit 810 further includes a bias control circuit 870 coupled to one terminal of the lamp, and a coupling approach of the bias control circuit 870 is also different from that of the bias control circuit 770 in FIG. 7. In FIG. 9, a lamp control unit 910 of a lamp power-saving system 900 has a structure similar to that of the lamp control circuit 610 in FIG. 6. However, the lamp control unit 910 further includes a bias control unit 970 that is coupled between the power conversion circuit 611 and the preheat and lighting circuit 620. The embodiments above are also applicable to the preheat and lighting circuit 720.

Figure 10:
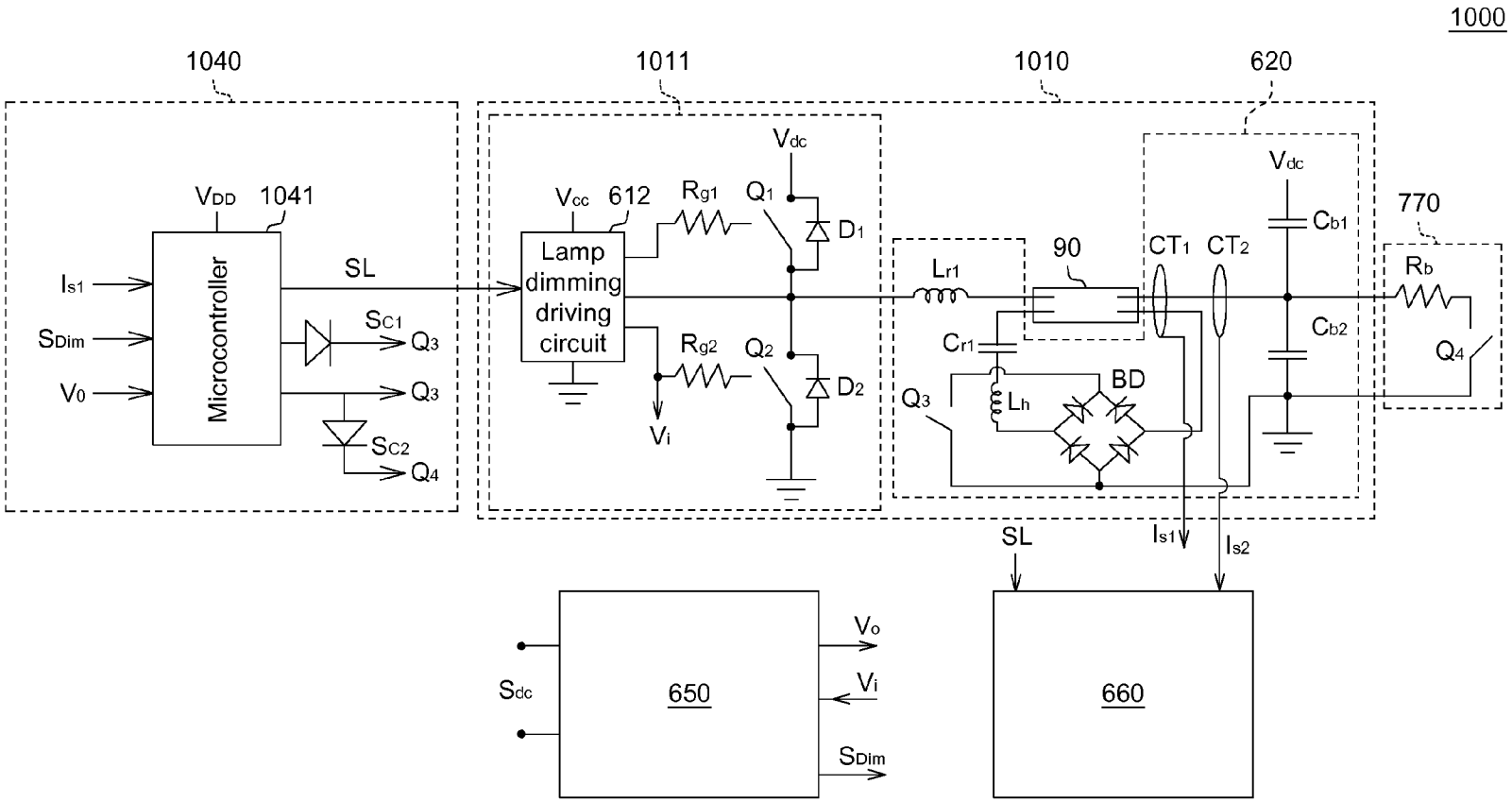
FIG. 10 is a block diagram of a lamp power-saving system according to yet another embodiment.

FIG. 10 is a block diagram of a lamp power-saving system according to one alternative embodiment. A main difference between a lamp power-saving system 1000 and the lamp power-saving systems in FIGS. 4, 6 and 7 is that, a system control unit 1040 utilizes a processing unit, e.g., a microprocessor or a microprocessor 1041, to perform functions of the first and second determination circuits. More specifically, according to the feedback signal Is1, the processing unit (i.e., the microprocessor 1041) outputs a first control signal $SC_1$ to activate or terminate preheating performed by the preheat and lighting circuit 620. Further, in response to the dimming signal $S_{Dim}$, after activating the fluorescent lamp 90, the processing unit (i.e., the microprocessor 1041) outputs a second control signal $SC_2$ to enable the bias control circuit 770. The enabled bias control circuit 770 then generates a bias signal for eliminating standing waves of the fluorescent lamp 90. The lamp power-saving system 1000 further utilizes a driving signal SL outputted by the microprocessor 1041 to control a power conversion circuit 1011 of a lamp control unit 1010, that is, to control the lamp dimming driving circuit 612. Details of other corresponding components are as those described in previous embodiments and are therefore omitted herein. Further, the dimming control unit 650 may be implemented by a digital circuit, and the setting signal Sdc may also be a digital input signal. In yet another embodiment, the dimming control unit 650 may be integrated to the system control unit 1040. Alternatively, the system control unit 1040 may receive a setting signal (e.g., a digital or voltage signal) indicating a dimming value for dimming, and also receive the frequency signal Vi to control the lamp dimming driving circuit 612.

Figure 11:
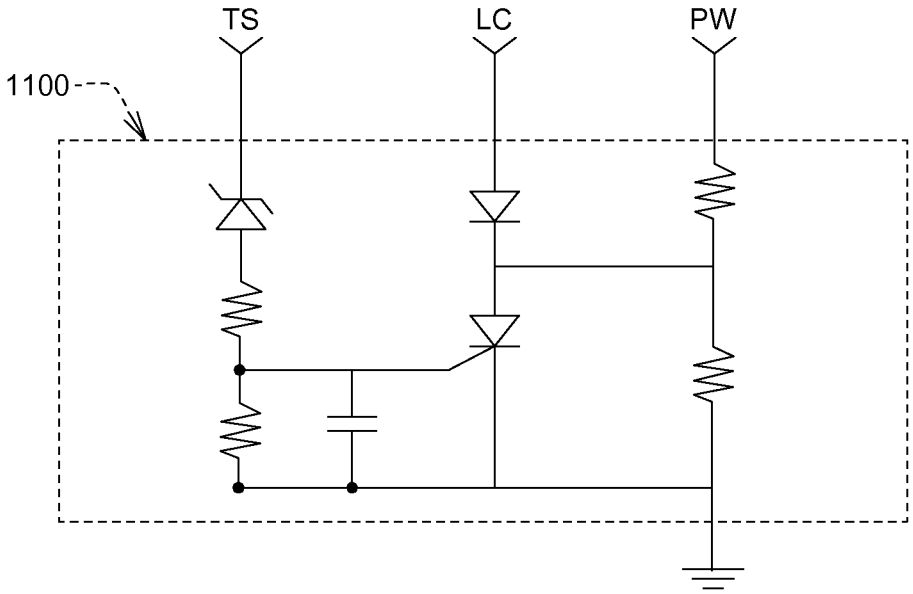
FIG. 11 is a circuit diagram of a protection control circuit according to one embodiment.

FIG. 11 is a circuit diagram of a protection control circuit according to another embodiment. Operations of a protection control circuit 1100 are similar to those of the protection control circuit 660. The protection control circuit 1100 utilizes a low-level determination element, e.g., a zener diode or a DIAC, and a protection controller, e.g., a TRIAC or an SCR. A DC power is connected to a PW terminal to provide a bias.

A feedback signal is coupled to a TS terminal. In the occurrence of an overcurrent, through the low-level determination element and the protection controller, a resistance at an LC terminal of the protection control circuit 1100 is reduced to terminate operations of connected circuits by providing a bypass, such that the circuit system does not keep operating under the overcurrent. Therefore, the implementation of a protection control unit is not limited to the protection control circuit 660 in FIG. 6. A circuit, capable of providing a bypass connecting to a control terminal of a power conversion circuit in response to a feedback indicating an overcurrent event to stop the power conversion circuit from outputting an AC signal, can also be implemented as the protection control circuit.

Figure 12:
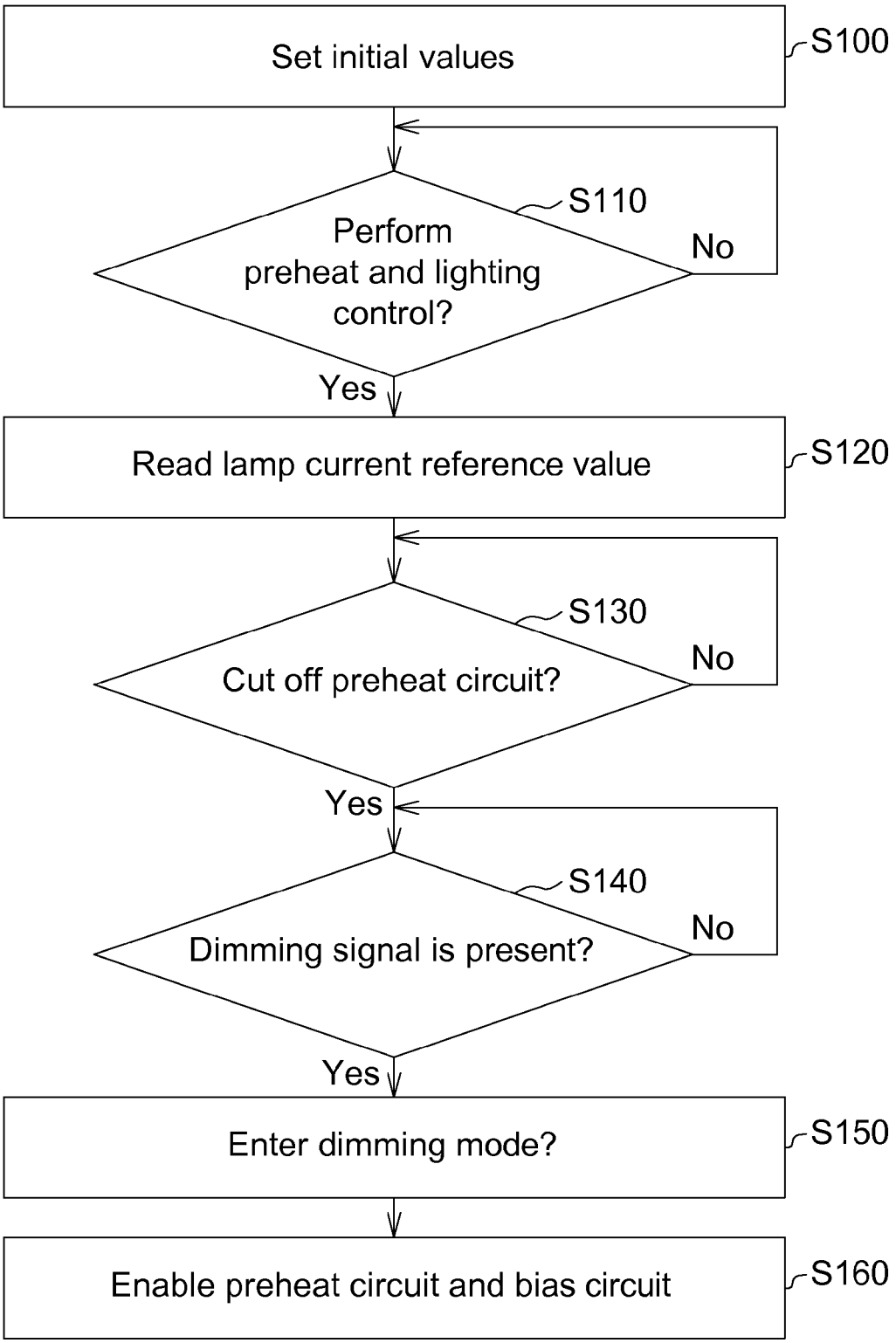
FIG. 12 is a flowchart of a process performed by a processing unit in the embodiment in FIG. 10 according to one embodiment.

FIG. 12 is a flowchart of a process performed by the processing unit in the embodiment in FIG. 2 according to one embodiment. As shown by step S100, the processing unit sets parameter initial values during a system activation. For example, initial values of the switch units such as the switch units $Q_3$ and $Q_4$ are set, and the lamp dimming driving circuit 612 is set to generate appropriate output signals for controlling alternate switching of the switch units $Q_1$ and $Q_2$. Further, during the system activation, a factor of whether the dimming signal SDim is present or absent (i.e., when $S_{Dim}$ is substantially zero) is also to be taken into consideration when setting the initial values. In step S110, preheat and lighting control is performed. The processing unit turns on the switch unit $Q_3$ and turns off the switch unit $Q_4$ to enable the other circuits to operate according to the initial values. After the preheat and lighting control is performed in step S110, the method proceeds to step S120. In step S120, the processing unit reads a current reference value (e.g., the feedback signal Is1) of the fluorescent lamp. In step S130, it is determined whether to disconnect the preheat circuit. The processing unit compares the feedback signal with a reference value. When it is determined to disconnect the preheat circuit, step S140 is performed to determine whether a dimming signal is present. For example, it is determined whether the dimming signal $S_{Dim}$ is greater than 0. Step S150 is performed when the dimming signal $S_{Dim}$ is present to enter a dimming mode. In step S160, the preheat circuit and the bias circuit are enabled. Details of corresponding circuits in FIGS. 12, 6 and 7 are similar and can be referred from the embodiments of the preheat and lighting circuit 720 and the bias control circuit 770, and thus will not be repeated herein for brevity.

The disclosure further provides a method for a lamp power-saving system. According to one embodiment, the method includes: A) providing a lamp control unit for controlling a fluorescent lamp; the fluorescent lamp including a power conversion circuit and a preheat and lighting circuit; the preheat and lighting circuit, being coupled to the power conversion circuit and two terminals of the fluorescent lamp, for preheating and activating the fluorescent lamp, and outputting a feedback signal indicating a current passing through the fluorescent lamp; B) when the feedback signals indicates the fluorescent lamp is in a preheat mode, enabling a resonance circuit of the preheat and lighting circuit to preheat the preheat and lighting circuit via a current path provided by a diode bridge; and C) when the feedback signal indicates the fluorescent lamp is lighted, disconnecting the current path in the preheat and lighting circuit to stop preheating. In one embodiment, the method further includes: D) when a dimming signal indicates dimming is required, after the fluorescent lamp is lighted, entering a dimming mode to enable the resonance circuit of the preheat and lighting circuit to preheat via a current path provided by the diode bridge. In another embodiment, the method further includes: E) when entering the dimming mode, inputting a bias signal to one of the two terminals of the fluorescent lamp to suppress standing waves generated by the fluorescent lamp. In another alternative embodiment, the method further includes a step of adding a protection mechanism. For example, the method further includes: F) when the feedback signal indicates an overcurrent event, providing a bypass connecting to a control terminal of the power conversion circuit to stop the power conversion circuit from outputting an AC signal to the preheat and lighting circuit. The method is applicable to the various embodiments of the foregoing lamp control system and the lamp power-saving system, and to embodiments realized by other circuit structures.

In conclusion, several embodiments of the lamp control system, the lamp power-saving system and the power-saving method for the lamp power-saving system are as disclosed above. In some embodiments, the lamp control system disconnects the preheat circuit after preheating is completed to reduce energy consumption. Further, the lamp control system may be implemented in different forms to provide design flexibilities in lamp control. For example, in some embodiments when dimming needed by dimming control, the preheat circuit again provides a current to the fluorescent lamp to stabilize a light output of the fluorescent lamp and thus to prolong the lifespan of the fluorescent lamp. Moreover, the mechanism of bias control may be added to suppress instantaneous standing waves of dimming. Further, the protection control mechanism may also be implemented so that the lamp control system enters a protection mode to stop operating and hence prevents hazards when the fluorescent lamp encounters an abnormality. Therefore, the above lamp control system may be implemented as a lamp power-saving system for achieving integrated, high efficiency and low power consumption lighting. Consequently, the control design of the fluorescent lamp becomes more flexible for favoring reduction in implementation cost, thereby increasing market competitiveness of the fluorescent lamp as well as promoting green lighting techniques to applications of different circumstances.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A lamp control system, comprising:

a lamp control unit, for controlling a fluorescent lamp, the lamp control unit comprising:

a power conversion circuit, for converting a DC signal to an AC signal, comprising a DC signal input terminal and an AC signal output terminal; and a preheat and lighting circuit, coupled to the AC signal output terminal and two terminals of the fluorescent lamp, for preheating and activating the fluorescent lamp and outputting a feedback signal indicating a current flowing through the fluorescent lamp;

wherein the preheat and lighting circuit comprises:

a resonance circuit, coupled to one of the two terminals of the fluorescent lamp;

a diode bridge, having two terminals respectively coupled to the two terminals of the fluorescent lamp, and one of the terminals being coupled to the fluorescent lamp via the resonance circuit;

a switching device, the diode bridge having two other terminals, the switching device being coupled to the two other terminals of the diode bridge; and a current detection device, for detecting the current of the fluorescent lamp to output the feedback signal; and a system control unit, for controlling the preheat and lighting circuit in response to the feedback signal;

wherein when the feedback signal is smaller than or equal to a threshold, the system control unit enables the switching device, and the resonance circuit performs preheating at the two terminals of the fluorescent lamp via a path provided by the diode bridge; and in response to the feedback signal being greater than the threshold indicating the fluorescent lamp is lighted, the system control unit disables the switching device so as to stop preheating.

2. The lamp control system according to claim 1, wherein the preheat and lighting circuit comprises:

a preheat circuit, coupled to the power conversion circuit and the two terminals of the fluorescent lamp;

a lighting circuit, coupled to the power conversion circuit and the two terminals of the fluorescent lamp; and a current detection device, for detecting the current of the fluorescent lamp to output the feedback signal;

in response to the feedback signal indicating the fluorescent lamp is in the preheat mode, the system control unit enables the preheat circuit to perform preheating at the two terminals of the fluorescent lamp; and in response to the feedback signal indicating the fluorescent lamp is lighted, the system control unit disables the preheat circuit to stop the preheating and continues to drive the fluorescent lamp by the lighting circuit.

3. The lamp control system according to claim 1, wherein the preheat and lighting circuit further comprises an anti-surge device coupled between the resonance circuit and the diode bridge.

4. The lamp control system according to claim 1, wherein the preheat and lighting circuit further comprises:

an isolation circuit, coupled to one of the two terminals of the fluorescent lamp, for receiving the DC signal to provide a divided voltage to the fluorescent lamp.

5. The lamp control system according to claim 1, wherein the preheat and lighting circuit further comprises a capacitive circuit coupled between the two terminals of the fluorescent lamp.

6. The lamp control system according to claim 1, wherein the system control unit comprises:

a first determination circuit, for outputting a first control signal according to the feedback signal to control the preheat and lighting circuit to start or stop preheating.

7. The lamp control system according to claim 1, wherein the system control unit further comprises:

a second determination circuit, in response to a dimming signal, for enabling the preheat and lighting circuit to preheat the fluorescent lamp after the fluorescent lamp is activated.

8. The lamp control system according to claim 7, further comprising:

a bias control circuit, coupled to one of the two terminals of the fluorescent lamp;

wherein in response to the dimming signal, after the fluorescent lamp is activated, the second determination circuit of the system control unit outputs a second control signal for enabling the bias control circuit to generate a bias signal for eliminating standing waves of the fluorescent lamp.

9. The lamp control system according to claim 1, wherein the system control unit comprises:

a processing unit, for outputting a first control signal according to the feedback signal to control the preheat and lighting circuit to start or stop preheating.

10. The lamp control system according to claim 9, further comprising:

a bias control circuit, coupled to one of the two terminals of the fluorescent lamp, wherein in response to a dimming signal, after the fluorescent lamp is activated, the processing unit outputs a second control signal for enabling the bias control circuit to generate a bias signal for eliminating standing waves of the fluorescent lamp.

11. A lamp power-saving system, comprising:

a power management unit, having an AC power input terminal and a DC signal output terminal; and a lamp control system, comprising:

a lamp control unit, for controlling a fluorescent lamp, the lamp control unit comprising:

a power conversion circuit, for converting a DC signal to an AC signal, comprising a DC signal input terminal and an AC signal output terminal; and a preheat and lighting circuit, coupled to the AC signal output terminal and two terminals of the fluorescent lamp, for preheating and activating the fluorescent lamp and outputting a feedback signal indicating a current flowing through the fluorescent lamp;

wherein the preheat and lighting circuit comprises:

a resonance circuit, coupled to one of the two terminals of the fluorescent lamp;

a diode bridge, having two terminals respectively coupled to the two terminals of the fluorescent lamp, and one of the terminals being coupled to the fluorescent lamp via the resonance circuit;

a switching device, the diode bridge having two other terminals, the switching device being coupled to the two other terminals of the diode bridge; and a current detection device, for detecting the current of the fluorescent lamp to output the feedback signal; and a system control unit, for controlling the preheat and lighting circuit in response to the feedback signal;

wherein when the feedback signal is smaller than or equal to a threshold, the system control unit enables the switching device, and the resonance circuit performs preheating at the two terminals of the fluorescent lamp via a path provided by the diode bridge; and in response to the feedback signal being greater than the threshold indicating the fluorescent lamp is lighted, the system control unit disables the switching device so as to stop preheating;

wherein the DC signal input terminal of the power conversion circuit is coupled to the DC signal output terminal of the power management unit.

12. The lamp power-saving system according to claim 11, wherein the power management unit comprises:

a first rectification filter circuit, coupled to the AC power input terminal;

a boost circuit, coupled to the first rectification filter circuit;

a transformer, having a primary side and a secondary side, the boost circuit being coupled between the primary side and an input terminal of the first rectification filter circuit; and a second rectification filter circuit, having an input terminal coupled to the secondary side of the transformer and an output terminal coupled to the DC signal input terminal of the power management unit.

13. The lamp power-saving system according to claim 11, further comprising:

a dimming control unit, coupled to the power conversion circuit, for outputting a dimming signal and controlling the power conversion circuit for dimming in response to a setting signal.

14. The lamp power-saving system according to claim 13, wherein the power conversion circuit further comprises a frequency output terminal and a frequency control terminal; the dimming control unit is coupled to the frequency output terminal and the frequency control terminal of the power conversion circuit, and controls the power conversion circuit via the frequency control terminal for dimming in response to the setting signal.

15. The lamp power-saving system according to claim 11, further comprising:

a protection control circuit, coupled to a control terminal of the power conversion circuit, for providing a bypass connecting to the control terminal in response to the feedback signal indicating an overcurrent event, so as to stop the power conversion circuit from outputting the AC signal from the AC signal output terminal.

16. A power-saving method for a power-saving system, comprising:

providing a lamp control unit for controlling a fluorescent lamp, wherein the lamp control unit includes: a power conversion circuit and a preheat and lighting circuit, and the preheat and lighting circuit, coupled to the power conversion circuit and two terminals of the fluorescent lamp, is for preheating and activating the fluorescent lamp, and outputting a feedback signal indicating a current flowing through the fluorescent lamp;

wherein the preheat and lighting circuit comprises:

a resonance circuit, coupled to one of the two terminals of the fluorescent lamp;

a diode bridge, having two terminals respectively coupled to the two terminals of the fluorescent lamp, and one of the terminals being coupled to the fluorescent lamp via the resonance circuit;

a switching device, the diode bridge having two other terminals, the switching device being coupled to the two other terminals of the diode bridge; and a current detection device, for detecting the current of the fluorescent lamp to output the feedback signal;

when the feedback signal is smaller than or equal to a threshold, enabling the resonance circuit of the preheat and lighting circuit to perform preheating at the two terminals of the fluorescent lamp via a current path provided by a diode bridge of the preheat and lighting circuit; and when the feedback signal is greater than the threshold indicating the fluorescent lamp is lighted, disconnecting the current path in the preheat and lighting circuit to stop the preheating.

17. The power-saving method according to claim 16, further comprising:

when a dimming signal indicates that dimming is required, after the fluorescent lamp is lighted, entering a dimming mode to enable the resonance circuit of the preheat and lighting circuit to perform preheating via the current path provided by the diode bridge.

18. The power-saving method according to claim 17, further comprising:

when entering the dimming mode, applying a bias signal to one of the two terminals of the fluorescent lamp to suppress standing waves of the fluorescent lamp.

19. The power-saving method according to claim 16, further comprising:

when the feedback signal indicates an overcurrent event, providing a bypass connecting to a control terminal of the power conversion circuit so as to stop the power conversion circuit from outputting an AC signal to the preheat and lighting circuit.

* * * * *